US012624918B2

(12) United States Patent
Hultman

(10) Patent No.: US 12,624,918 B2
(45) Date of Patent: May 12, 2026

(54) END CAP ADAPTER FOR BATON

(71) Applicant: Defense Technology, LLC, Casper, WY (US)

(72) Inventor: John Hultman, Casper, WY (US)

(73) Assignee: Defense Technology, LLC, Casper, WY (US)

( * ) Notice: Subject to any disclaimer, the term of this patent is extended or adjusted under 35 U.S.C. 154(b) by 417 days.

(21) Appl. No.: 17/961,254

(22) Filed: Oct. 6, 2022

(65) Prior Publication Data

US 2023/0126526 A1 Apr. 27, 2023

Related U.S. Application Data

(60) Provisional application No. 63/272,465, filed on Oct. 27, 2021.

(51) Int. Cl.
*F41B 15/02* (2006.01)

(52) U.S. Cl.
CPC ..... *F41B 15/025* (2013.01)

(58) Field of Classification Search
CPC ..... F41B 15/02
USPC ..... 463/47.7
See application file for complete search history.

(56) References Cited

U.S. PATENT DOCUMENTS 6,543,629 B1 4/2003 Samelson
6,623,361 B1 * 9/2003 Parsons ..... F41B 15/022 463/47.7
D691,692 S 10/2013 Sheikh et al.
8,568,242 B2 10/2013 Milligan
8,747,233 B1 * 6/2014 Klein ..... F41B 15/02 463/47.7
D710,481 S 8/2014 Walter et al.
8,869,999 B2 10/2014 Lindo et al.
D725,202 S 3/2015 Hunt et al.
2007/0087844 A1 * 4/2007 Labes ..... F41B 15/027 463/47.7
2014/0194212 A1 7/2014 Walter et al.

FOREIGN PATENT DOCUMENTS

CN 306086693 S 10/2020
CN 306119596 S 10/2020
TW D145316 S1 2/2012

OTHER PUBLICATIONS

Taiwan Design Patent Application No. 112301800—Examination Report dated Nov. 21, 2023.
Taiwan Design Patent Application No. 112301799—Examination Report dated Nov. 21, 2023.
PCT Application No. PCT/US22/47006—International Search Report and Written Opinion dated Mar. 17, 2023.
European Patent Application No. 22887948.2—Partial Search Report dated Dec. 10, 2024.

* cited by examiner

*Primary Examiner* — Michael C Grant
(74) *Attorney, Agent, or Firm* — Kane Kessler, P.C.; Paul E. Szabo; Barry E. Negrin

(57) ABSTRACT

An adapter for a cylindrical end cap of a multi-section locking baton. The adapter has a non-cylindrical outer side surface thereby providing the end of the baton with a non-cylindrical outer side configuration, such as a wedge shape or a domed shape.

12 Claims, 7 Drawing Sheets

END CAP ADAPTER FOR BATON

BACKGROUND OF THE INVENTION

A baton of the type shown generally in US Patent Publication No. 2014/0194212 has a tubular handle that forms the outermost of a series of telescoping tubes. The handle includes an end cap. The end cap has an externally threaded projecting end portion that is screwed into the open end of the handle, to close off the end of the tubular handle. The end cap supports a push button on the end of the baton. The push button is connected for movement with a release rod. When the baton is extended and the push button is pushed, the release rod is activated to enable opening or closing of the baton.

These batons typically are offered for sale with any one of three different end cap styles: "standard", "wedge", and "domed/Hindi" style. See FIG. 15 herein, and also see U.S. Pat. No. D710,481, which illustrates a wedge-shaped end cap. The choice of end cap is a user preference for appearance and grip. The purchaser selects one end cap when purchasing the baton. Being integral to the baton build, each cap variant requires a unique build and manufacturing process. This is the case both for extendable batons and for single length batons.

SUMMARY OF THE INVENTION

The present invention provides adapters that can be used on a baton in conjunction with the standard end cap, or with any existing end cap. The adapter covers some or all of the end cap and converts it to a visually different end cap, such as a wedge style cap or a domed/Hindi style cap. The adapters easily fit over the existing end cap and can be installed by the end user with no special tooling or training necessary. The adapters provide the look and feel of another end cap.

In one embodiment, the invention is an adapter for a cylindrical end cap of a baton. The adapter has a non-cylindrical outer side surface thereby providing the end of the baton with a non-cylindrical outer side configuration, including but not limited to a wedge shape or a domed shape.

In one embodiment, the invention is a multi-section locking baton comprising a series of lockable telescoping tubes that lock when the baton is extended, one of the telescoping tubes being a handle of the baton. A manually actuatable release rod extends axially through the telescoping tubes for unlocking the tubes. An end cap is connected with the handle and closes the outer end of the handle. The end cap supports a push button on the end of the baton, the push button being connected for movement with the release rod whereby pushing the push button moves the release rod to enable unlocking of the tubes and closing of the baton. The end cap has a first outer configuration. An adapter is fitted over the end cap thereby to provide the end of the baton with a second outer configuration different from the second outer configuration.

In another embodiment, the invention is an adapter for the end cap of a multi-section locking baton. The baton includes a series of lockable telescoping tubes that lock when the baton is extended, one of the telescoping tubes being a handle of the baton. The baton also includes a manually actuatable release rod extending axially through the telescoping tubes for unlocking the tubes. The baton also includes an end cap that is connected with the handle and that closes the outer end of the handle, the end cap supporting a push button on the end of the baton, the push button being connected for movement with the release rod whereby pushing the push button moves the release rod to enable unlocking of the tubes and closing of the baton. The end cap has a cylindrical outer configuration. The adapter includes a side wall having a cylindrical inner side surface defining a cylindrical inner chamber for receiving the cylindrical end cap. The adapter side wall has a non-cylindrical outer side surface thereby providing the end of the baton with a non-cylindrical outer side configuration.

BRIEF DESCRIPTION OF THE DRAWINGS

The foregoing and other features of the invention will become apparent to one of ordinary skill in the art to which the invention pertains, from a reading of the following description of an embodiment together with the accompanying drawings, wherein.

DESCRIPTION OF AN EMBODIMENT OF THE INVENTION

Figure 1:
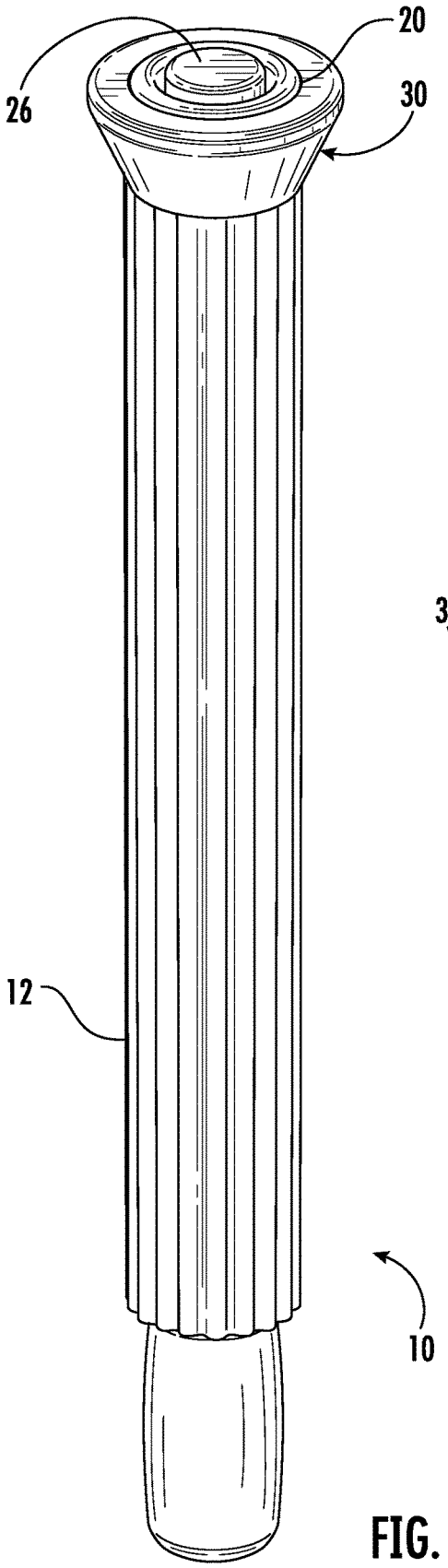
FIG. 1 is a perspective view of an extendable baton in accordance with a first embodiment of the invention, including a wedge adapter covering a standard end cap.
Figure 2:
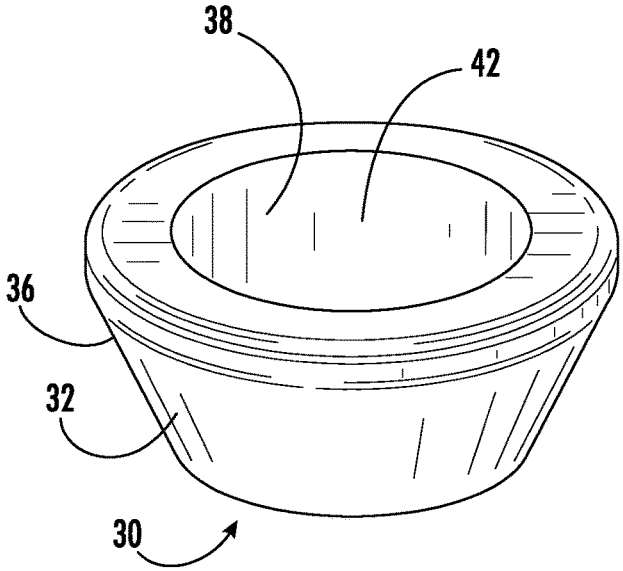
FIG. 2 is an enlarged perspective view of the wedge adapter of the baton of FIG. 1.
Figure 3:
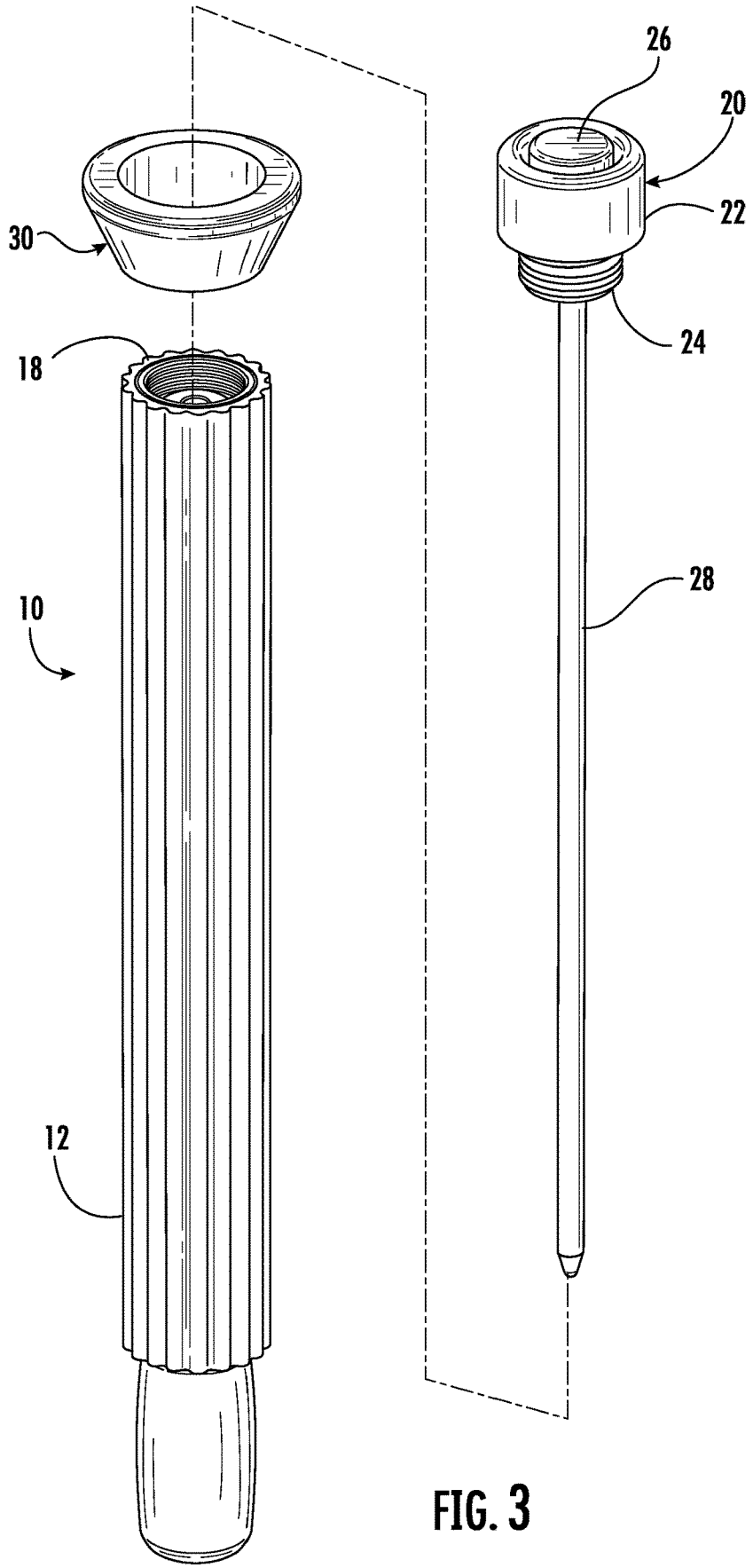
FIG. 3 is an exploded perspective view of parts of the baton of FIG. 1.

The present invention relates to a baton, including but not limited to a baton of the type used by police officers. The invention is applicable to batons of different and varying constructions. For example, the invention is illustrated with respect to an extendable baton, although it is applicable also to a non-extendable (fixed length) baton. As representative of the invention, FIG. 1 illustrates an extendable baton 10 that is a first embodiment of the invention.

The baton 10 includes three telescoping tubes that can be closed to shorten the baton or extended (expanded) to lengthen the baton. The three tubes include, first, an outer tube or handle 12 that is largest in diameter; second, a middle tube 14 that is smaller in diameter than the outer tube and that telescopes within the outer tube; and third, an inner tube 16 that is smaller in diameter than the middle tube and that telescopes within the middle tube. The outer tube 12 has an open outer end portion 18.

Figure 9:
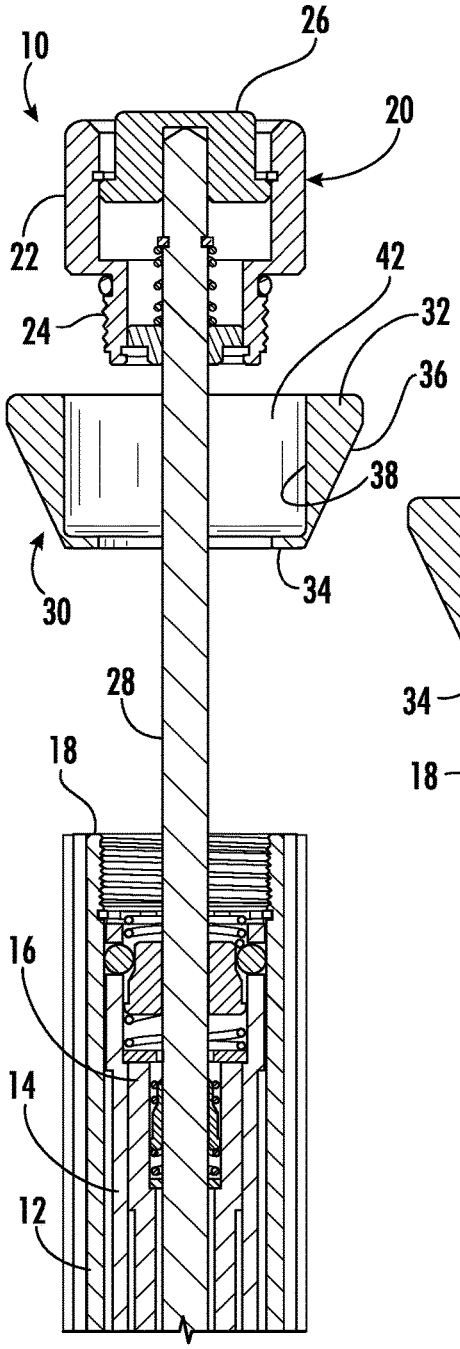
FIGS. 9 through 11 are exploded sectional views illustrating assembly of the wedge adapter onto the baton with standard end cap.
Figure 10:
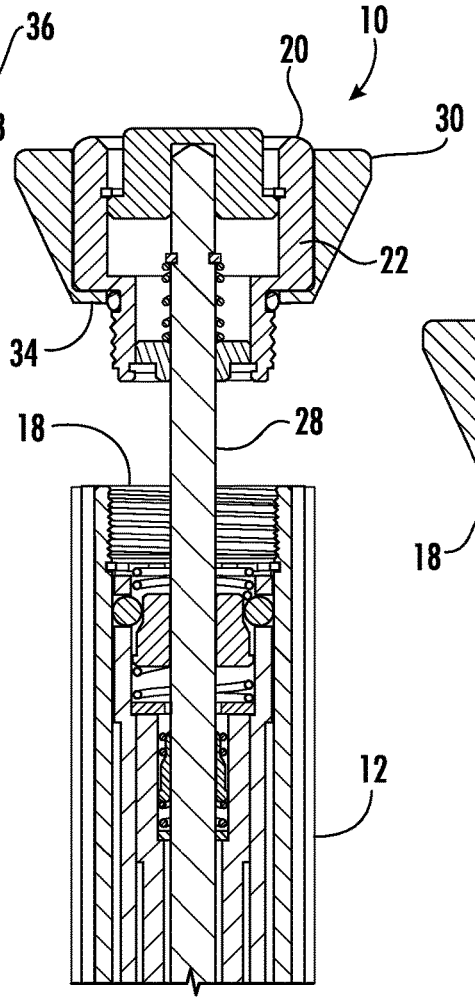
Figure 11:
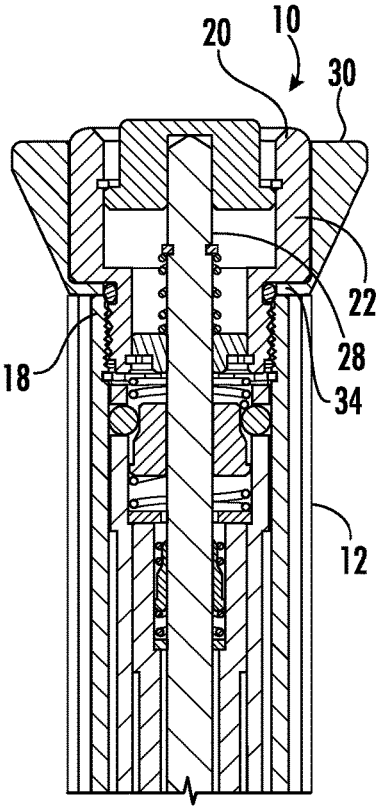

The baton 10 (FIG. 9) includes an end cap 20. The particular end cap 20 that is illustrated is known as a "standard" end cap, having a main body portion 22 that is configured externally as a right circular cylinder. (As noted, the invention is not limited to an adaptor for that particular configuration of end cap.) The end cap 20 has a narrower diameter, externally threaded, projecting end portion 24 that is screwed into the open end portion 18 of the handle 12. The end cap 20 thus closes off the end of the handle 12.

The main body portion 22 of the end cap 20 supports a push button 26 on the end of the baton 10. The push button 26 is connected for movement, internally of the baton, with a release rod 28, for unlocking or releasing the tubes 12-16. When the baton 10 is closed and the push button 26 is pushed, the release rod 28 is activated, so that the baton can be extended and then locked in the open position. When the baton 10 is extended and the push button 26 is pushed, the release rod 28 is again activated, to enable closing of the baton.

Figure 12:
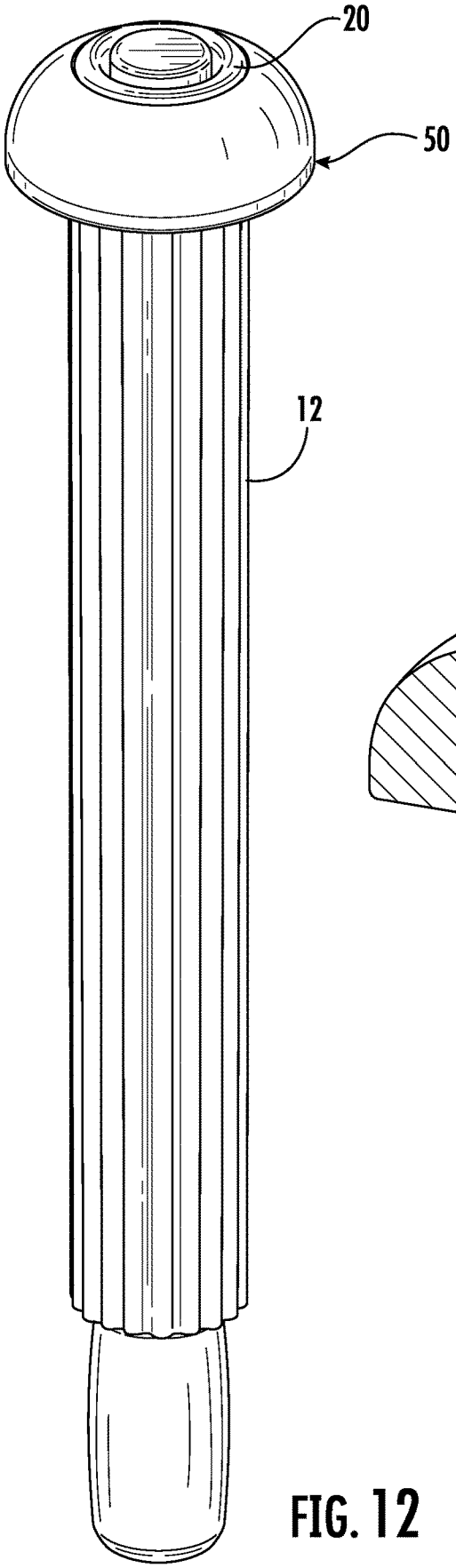
FIG. 12 is a perspective view similar to FIG. 1 of a baton with a domed end cap adapter.
Figure 13:
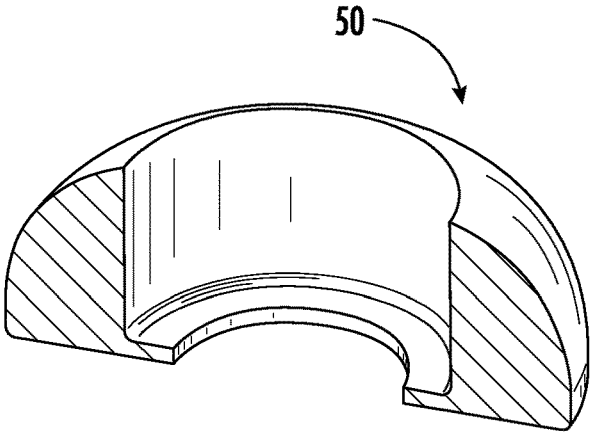
FIG. 13 is a sectional of view the domed end cap adapter of FIG. 12.
Figure 15:
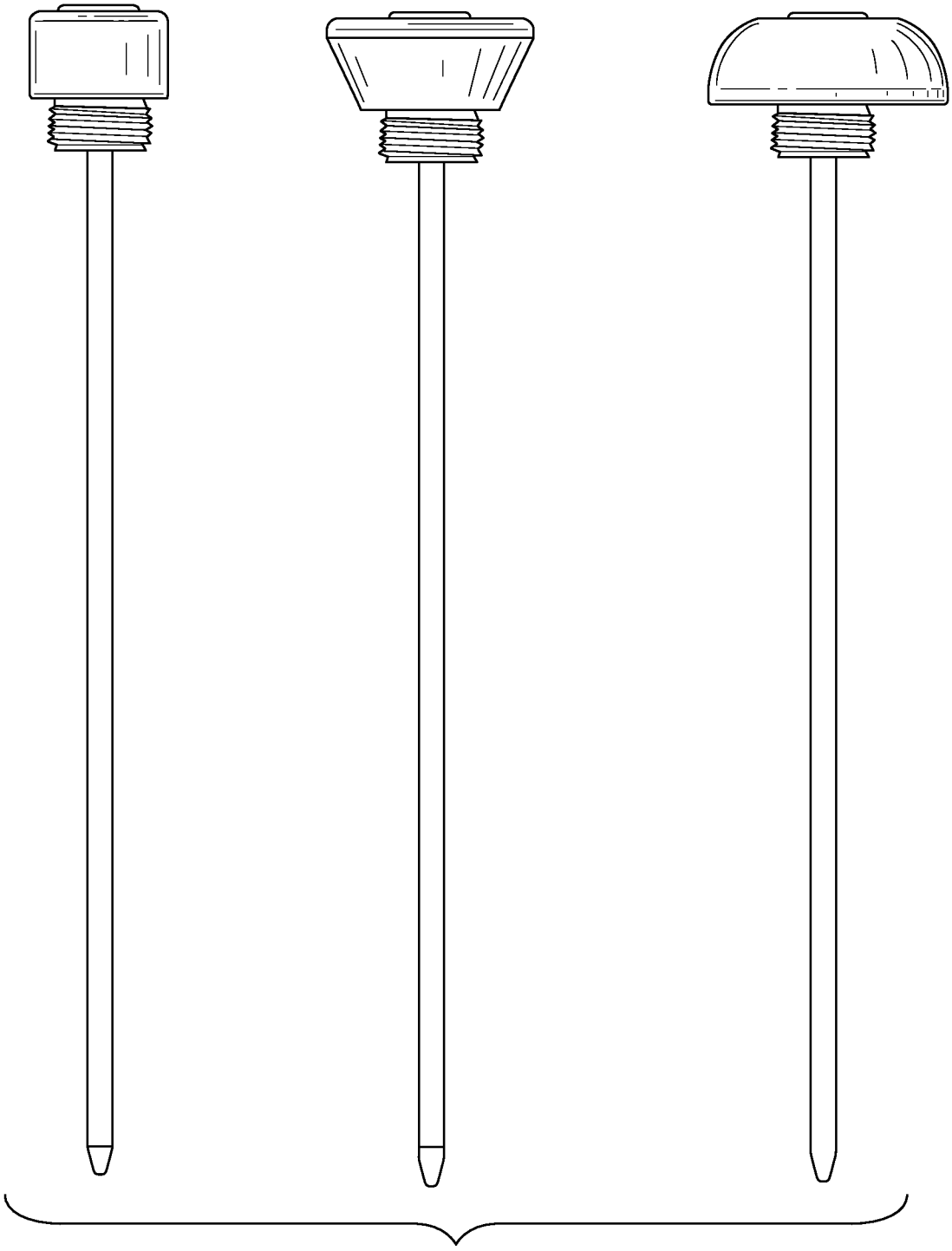
FIG. 15 (PRIOR ART)
FIG. 15 shows the existing standard, wedge, and domed baton end caps.

In accordance with a feature of the invention, a cover or adapter is provided that can be used in conjunction with an existing baton end cap, effectively converting it to a different style end cap. The adapter can be installed by the end user with no special tooling or training necessary. This process is illustrated in FIGS. 3-8 with regard to a wedge adapter 30 that simulates the visual appearance of a prior art wedge-shaped end cap of the type that is shown in FIG. 15. The invention also provides a domed adapter 50 as seen in FIGS. 12 and 13 that simulates the visual appearance of a prior art dome-shaped end cap of the type that is shown in FIG. 15, having a hemispherical outer side surface.

The wedge adapter 30 (FIGS. 3-8) has a tubular configuration, including a side wall 32 and an end wall 34. The side wall 32 has a frustoconical outer side surface 36. The outer side surface 36 of the wedge adapter 30 is configured to present a similar or substantially the same outer appearance as the outer surface of the existing wedge end cap shown in FIG. 15. The side wall 32 also has a cylindrical inner side surface 38 that defines a cylindrical central chamber 42 that is configured to receive closely the standard end cap 20.

The adapter end wall 34 extends radially inward from the inner side surface 38 of the side wall, forming an annular flange or lip that is the axially inner boundary of the central chamber 42. The end wall or lip 34 has a circular central opening 46 that is configured to receive closely the projecting end portion 24 of the standard end cap 20. The overall length of the wedge adapter 30 is substantially the same as or just slightly longer than the length of the standard end cap 20.

FIGS. 4-8 illustrate the process of installation of the wedge adapter 30 on a baton that already includes a standard end cap 20.

Figures 4, 5, 6, 7, 8:
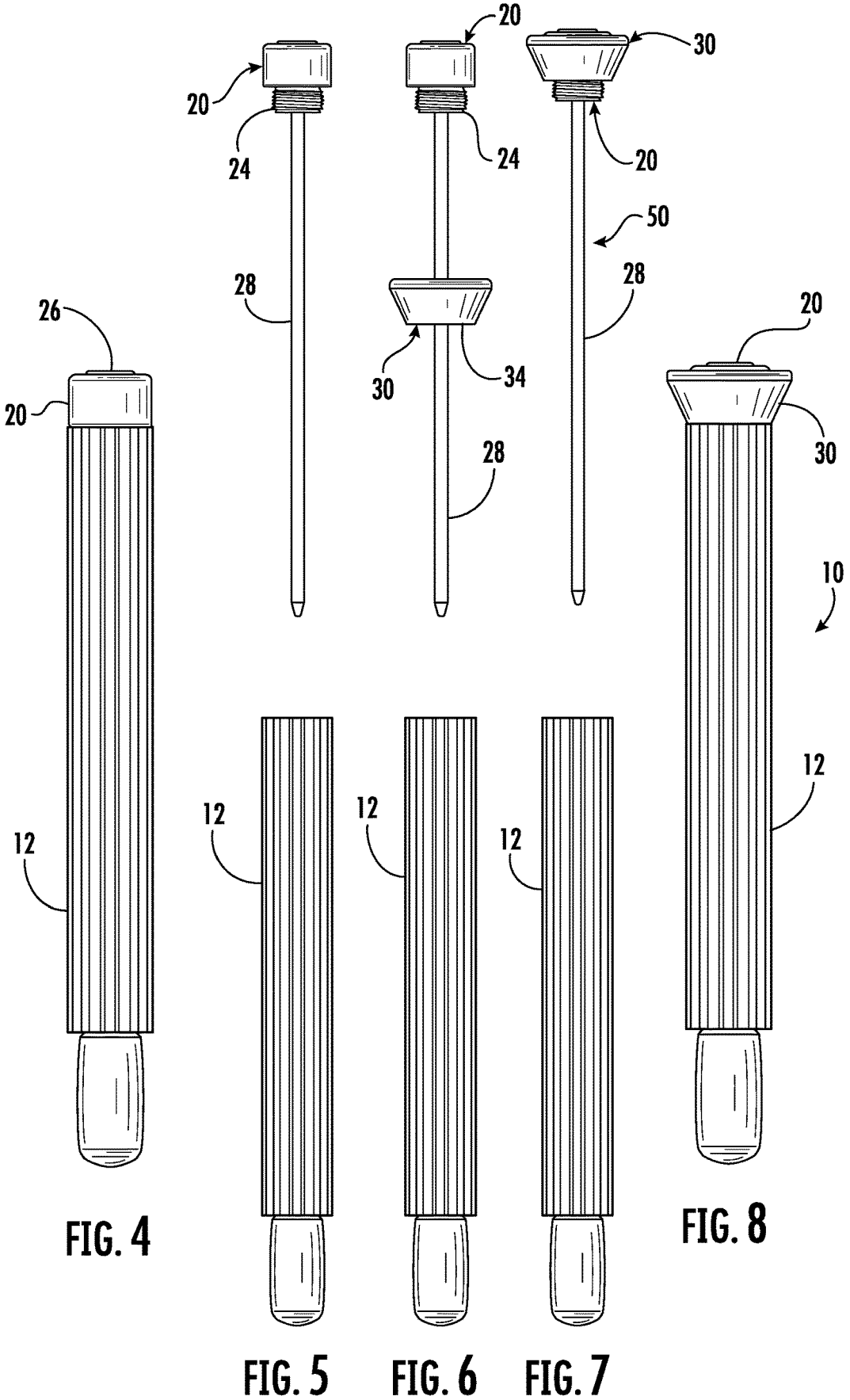
FIG. 4 is an elevational view of the baton of FIG. 1 but not including the wedge adapter.
FIG. 5 is an elevational view of the baton of FIG. 4 in a disassembled condition with the standard end cap and the release rod having been removed.
FIGS. 6 through 8 are elevational views illustrating assembly of the wedge adapter onto the baton with standard end cap.

In a first step (FIG. 5), the standard end cap 20 and release rod 28 are removed by unscrewing from the handle 12. Then, the adapter 30 is slid over the release rod 28 in a direction toward the end cap 20 (FIG. 6). The adapter 30 is moved into a position in engagement with the end cap 20 (FIG. 7). Specifically, the annular lip 34 on the adapter 30 encircles the outer end portion 24 of the end cap 20 and seats against the main body portion 22 of the end cap 20.

The result is an assembly 50 (FIG. 7) that includes the standard end cap 20, the wedge adapter 30, and the release rod 28. The wedge adapter 30 covers the side of the standard end cap 20, but not the outer end.

This assembly 50 is then reinstalled (FIGS. 8-11) by connecting with the handle 12. Specifically, the outer end portion 24 of the standard end cap 20 is screwed into the handle 12. The lip 34 on the adapter 30 is clamped between the handle 12 and the main body portion 22 of the standard end cap 20. The adapter 30 is thereby secured on the handle 12.

The result is a baton that keeps the existing standard end cap 20, but which, by the use of the wedge adapter 30, now has what is effectively a wedge end cap having the same look and feel as an original issue wedge style baton (FIG. 15). The adapter 30 both changes the visual appearance from the cylindrical shape of the standard end cap 20, and provides a different feel and grip for the user. The overall length of the reconfigured baton is substantially the same.

One advantage of the present invention is that adapter can be installed by the end user or agency with no special tooling or training necessary. Another advantage is a reduction in manufacturing costs and complexity; the manufacturer need only make standard end caps and two different styles of adapters, rather than three different end caps. The utilization of baton adapters can allow the manufacturer to reduce the cost of carrying multiple finished baton styles and the respective components for each configuration. This change can account for as much as a 66% reduction in overall finished goods offerings.

The production and need for the "standard" end cap offering can increase to meet demand to offset the integral wedge and dome style batons. This increase in production volume allows greater amortization of manufacturing related expenses, providing a reduction in finished goods costs. Direct and indirect labor costs will also be lowered as the complexity of the finished goods inventory is condensed, allowing for greater efficiencies during assembly and process management. Additionally, with the number of individual product offerings decreased, a reduction in support materials and labor hours would be realized in marketing, sales and training.

Figure 14:
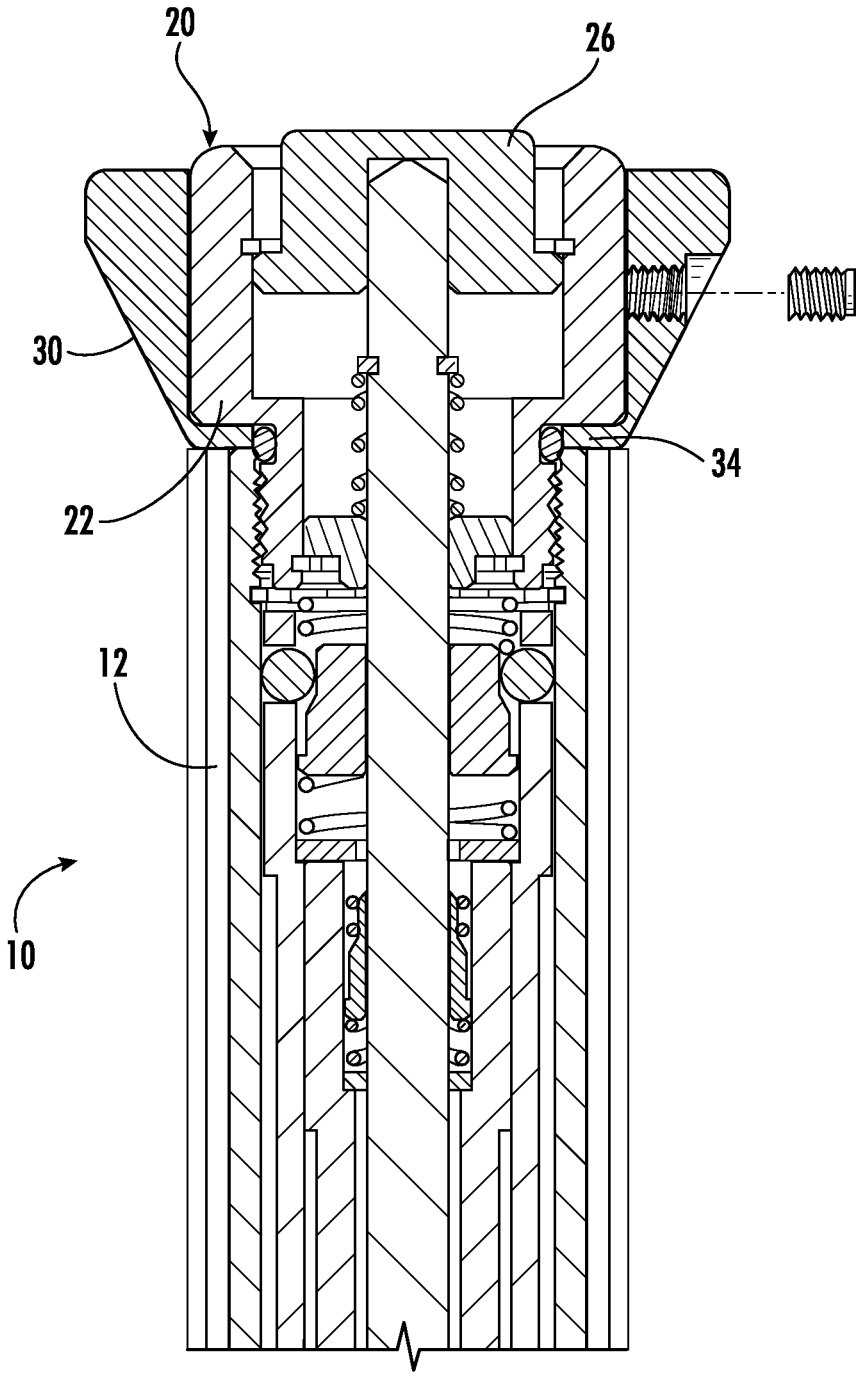
FIG. 14 is a sectional view illustrating the use of a set screw to assist in securing the adapter on the standard end cap.

The invention is also applicable to existing batons already in use, reducing replacement costs and promoting affordable upgrades. The invention is applicable to batons that have an O-ring or similar between the end cap and the handle. Also, it may be desirable to add a set screw to the side of the adapter cap to help lock it to the parent standard cap. This feature is illustrated in FIG. 14.

From the above description of the invention, those skilled in the art will perceive improvements, changes and modifications in the invention. For example, the invention is applicable to expandable batons with other than three sections, such as two section batons. The invention is applicable to non-expandable batons. The invention is also applicable to different end cap shapes other than cylindrical or wedge-shaped or domed. Such improvements, changes and modifications within the skill of the art are intended to be covered by the appended claims.

The invention claimed is:

1. A multi-section locking baton comprising:

a series of lockable telescoping tubes that lock when the baton is extended, one of said telescoping tubes being a handle of the baton;

a manually actuatable release rod extending axially through the telescoping tubes for unlocking the tubes;

an end cap that is connected with the handle and that closes the outer end of the handle;

the end cap supporting a push button on the end of the baton, the push button being connected for movement with the release rod whereby pushing the push button moves the release rod to enable unlocking of the tubes and closing of the baton;

the end cap having a first outer configuration; and an adapter that is fitted over the end cap thereby to provide the end cap with a second outer configuration different from the first outer configuration.

2. A baton as set forth in claim 1 wherein the end cap has a cylindrical outer configuration;

the adapter has a cylindrical inner chamber receiving the end cap; and the adapter has a non-cylindrical outer configuration thereby providing the end cap with a non-cylindrical outer configuration.

3. A baton as set forth in claim 1 wherein the adapter has a wedge shape including a frustoconical outer side surface.

4. A baton as set forth in claim 1 wherein the adapter has a domed shape including a hemispherical outer side surface.

5. A baton as set forth in claim 1 wherein the adapter has a lip that is clamped between the end cap and the handle when the adapter is fitted over the end cap thereby to secure the adapter in position on the end cap.

6. A baton as set forth in claim 5 wherein the end cap has a cylindrical, externally threaded end portion that is screwed into the handle, and the adapter lip has an annular configuration that encircles the end portion of the end cap when the adapter is installed on the end cap.

7. A baton as set forth in claim 5 wherein the adapter is substantially the same length as the end cap.

8. An adapter for the end cap of a multi-section locking baton;

the baton including a series of lockable telescoping tubes that lock when the baton is extended, one of said telescoping tubes being a handle of the baton;

the baton also including a manually actuatable release rod extending axially through the telescoping tubes for unlocking the tubes;

the baton also including an end cap that is connected with the handle and that closes the outer end of the handle, the end cap supporting a push button on the end of the baton, the push button being connected for movement with the release rod whereby pushing the push button moves the release rod to enable unlocking of the tubes and closing of the baton, the end cap having a cylindrical outer configuration; and said adapter including a side wall having a cylindrical inner side surface defining a cylindrical inner chamber for receiving the cylindrical end cap; and said adapter side wall having a non-cylindrical outer side surface thereby providing the end cap with a non-cylindrical outer side configuration.

9. An adapter as set forth in claim 8 having a wedge shape including a frustoconical outer side surface.

10. An adapter as set forth in claim 8 having a domed shape including a hemispherical outer side surface.

11. A baton as set forth in claim 8 wherein the adapter has a lip that is clamped between the end cap and the handle when the adapter is fitted over the end cap thereby to secure the adapter in position on the end cap.

12. An adapter for a cylindrical end cap of a baton;

the adapter having a non-cylindrical outer side surface thereby providing the end cap of the baton with a non-cylindrical outer side configuration, such as a wedge shape or a domed shape.

* * * * *